US012637260B1

(12) United States Patent
Ferniany

(10) Patent No.: US 12,637,260 B1
(45) Date of Patent: May 26, 2026

(54) CUP LID AND METHOD OF USING SAME

(71) Applicant: Isaac William Ferniany, Birmingham, AL (US)

(72) Inventor: Isaac William Ferniany, Birmingham, AL (US)

( * ) Notice: Subject to any disclaimer, the term of this patent is extended or adjusted under 35 U.S.C. 154(b) by 0 days.

(21) Appl. No.: 19/008,477

(22) Filed: Jan. 2, 2025

(51) Int. Cl.
*B65D 43/02* (2006.01)

(52) U.S. Cl.
CPC ..... *B65D 43/0225* (2013.01); *B65D 2205/02* (2013.01); *B65D 2543/00046* (2013.01)

(58) Field of Classification Search
CPC ..... B65D 43/0225; B65D 2205/02; B65D 2543/00046
USPC ..... 220/288, 713; 215/318, 321
See application file for complete search history.

(56) References Cited

U.S. PATENT DOCUMENTS 5,785,195 A * 7/1998 Zwemer ..... B65D 41/04 215/349
6,056,145 A * 5/2000 Rush ..... B65D 43/0231 220/784
6,105,801 A * 8/2000 Minnette ..... B65D 1/023 215/331
9,499,312 B1 * 11/2016 Gilliam ..... B65D 41/125
9,604,764 B2 3/2017 Bailey
10,836,549 B2 11/2020 Maguire
2003/0192891 A1 * 10/2003 Ziegler ..... A47G 19/2272 220/717
2010/0301109 A1 * 12/2010 Lewis ..... B65D 3/04 229/404

FOREIGN PATENT DOCUMENTS

WO 2020178132 A1 9/2020
WO 2023249061 A1 12/2023

* cited by examiner

*Primary Examiner* — James N Smalley
(74) *Attorney, Agent, or Firm* — C. Brandon Browning; Maynard Nexsen PC

(57) ABSTRACT

A lid for a cup that includes a top cover, a first continuous sidewall, a curved, second continuous sidewall that forms an annular groove, a third sidewall that terminates to form a rim, and a plurality of ridges. The plurality of ridges are arranged circumferentially on and protruding radially inwardly from an inner surface of the third continuous sidewall. Each ridge of the plurality of ridges includes a first end adjacent to the annular groove, a second end arranged adjacent to the rim, and a height that progressively increases as each ridge extends downwardly from the lid. The lid can be secured to a cup by pressing the lid against the ridges while rotating the lid. The lip of the lid is deformed when the ridges press against it. The lip slides along the entire length of the ridges before being deposited in the annular groove.

20 Claims, 7 Drawing Sheets

CUP LID AND METHOD OF USING SAME

FIELD OF INVENTION

The present invention is directed to a cup lid and method of using same and, more particularly, to a plastic lid configured for progressively increasing a friction fit tightness between the lid and a cup rim when the lid is rotated and pressed onto the rim.

BACKGROUND OF THE INVENTION

Plastic lids for cups, such as coffee cups, are known in the art. For example, U.S. Pat. No. 9,604,764 discloses a lid for beverages with foam, the lid including an annular mounting portion to removably, sealingly, engage the open lip of a round beverage cup, a raised annular ridge inset from the mounting portion extending from a first end to a second end and a central portion spanning the annulus. and including an aroma aperture at the center. A dispensing portion spans between the annular ridge first end and second end including a front flat portion, a sloped dispensing aperture surface, and a dispensing aperture disposed on the sloped surface. The dispensing aperture includes a triangle with rounded corners having a base proximate and parallel to the intersection edge and an apex proximate the upper edge. The raised annular ridge and dispensing portion define a continuous containment surrounding the central portion.

WO 2023/249061A1 discloses a lid formed from a paper material that is joinable to a container that has an opening portion formed at the upper end thereof and an edge portion forming an outer periphery of the opening portion. The lid includes a joint region-corresponding portion corresponding to a region that is joined to the container along the edge portion of the container and a lid region-corresponding portion composed of a portion inside the joint region-corresponding portion. The lid region-corresponding portion has an obstruction portion inside a circumferential edge of the lid region-corresponding portion and as a height-difference portion and a penetration portion in at least a part of the inside of an inner edge of the obstruction portion.

Also known in the art are container lids having discontinuous closure reliefs. For example, WO 2020/178132A1 discloses a cosmetic packaging and dispensing container having a longitudinal axis X and a cover which is removably disposed on the container. The container includes at least two isolated, protruding locking reliefs capable of cooperating with two complementary protruding engagement reliefs provided on the cover.

A shortcoming of conventional lids is that such lids may appear to be sealingly, secured about an open top of a cup when they are in fact not. In view of this shortcoming, there is a need in the art for a lid that can be consistently and quickly sealingly, secured to an opentop of a cup.

SUMMARY OF THE INVENTION

The present invention addresses the shortcoming of conventional cup lids by providing a lid having a number of ridges extending radially inward from an inner surface of a continuous sidewall of the lid that are configured to enage a lip of the cup and form corresponding indentations in the cup lip whereby the ridges and indentations secure the lid to the cup and guide the lid, as the lid is rotated and pressed against the lip, towards an annular groove formed in the sidewall. According to one aspect of the invention, there is provided a lid including a top cover and a first continuous sidewall extending downwardly from an outer edge of the top cover. A curved, second continuous sidewall extends downwardly from the first continuous sidewall and includes an annular groove formed by the curve. A third continuous sidewall extends downwardly from a lower edge of the second continuous sidewall and tapers outwardly from the lower edge of the second continuous wall before terminating to form a rim. A plurality of ridges are arranged circumferentially on an inner surface of the third continuous sidewall. Each ridge protrudes radially inward from the inner surface of the third continuous sidewall, has a first end arranged adjacent to the annular groove and a second end arranged adjacent to the rim and a height that progressively increases as the ridge extends from the second end to the first end. A plurality of channels are defined by and between the plurality of ridges with each channel having a pitch in the range of about 25 mm to about 45 mm.

According to another aspect of the invention, there is provided a method of securing a plastic lid to a cup. The method includes providing a lid having a top, a continuous sidewall that extends downwardly from the top and terminates to form a rim, an annular groove formed within the continuous sidewall and a plurality of ridges. The plurality of ridges are arranged circumferentially on an inner surface of the continuous sidewall and protrude radially inward from the inner surface of the continuous sidewall. Each ridge includes a first end arranged adjacent to the annular groove, a second end arranged adjacent to the rim and a height that progressively increases as the ridge extends between from the second end to the first end. The rim is arranged around a lip of the cup, and the second end of each of the ridges is contacted with the lip. The lid is then pressed against the plurality of ridges while being rotated whereby each ridge to deform the lip. The cup lip is slid along the plurality of ridges from the second end to the first end of each ridge until the lip is deposited within the annular groove.

According to another aspect of the invention, there is provided a cup lid including a top cover, a continuous sidewall extending downwardly from the top cover and terminating to form a continuous rim and an annular groove formed in the continuous sidewall. A continuous sidewall portion extends to and between an edge of the annular groove and the continuous rim, the continuous sidewall portion tapering outwardly from the edge of the annular as it extends to the continuous rim. A plurality of ridges is arranged circumferentially on and protruding radially inwardly from an inner surface of the continuous sidewall portion with each ridge of the plurality of ridges including a first end arranged adjacent to the annular groove, a second end arranged adjacent to the continuous rim and a height that progressively increases as the ridge extends from the second end to the first end. No ridge of the plurality of ridges contacts another ridge of the plurality of ridges.

Other features and advantages of the present application will be apparent from the following more detailed description of the identified aspects of the inventions, taken in conjunction with the accompanying drawings which illustrate, by way of example, the principles of the application.

DETAILED DESCRIPTION OF THE DRAWINGS

Figure 1:
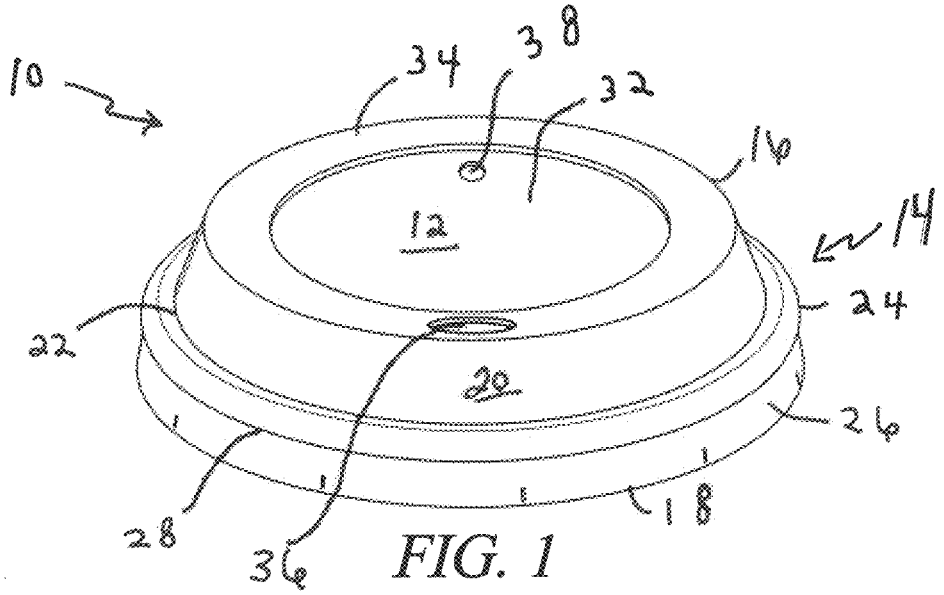
FIG. 1 is a top perspective view of a lid in accordance with the present invention.
Figure 2:
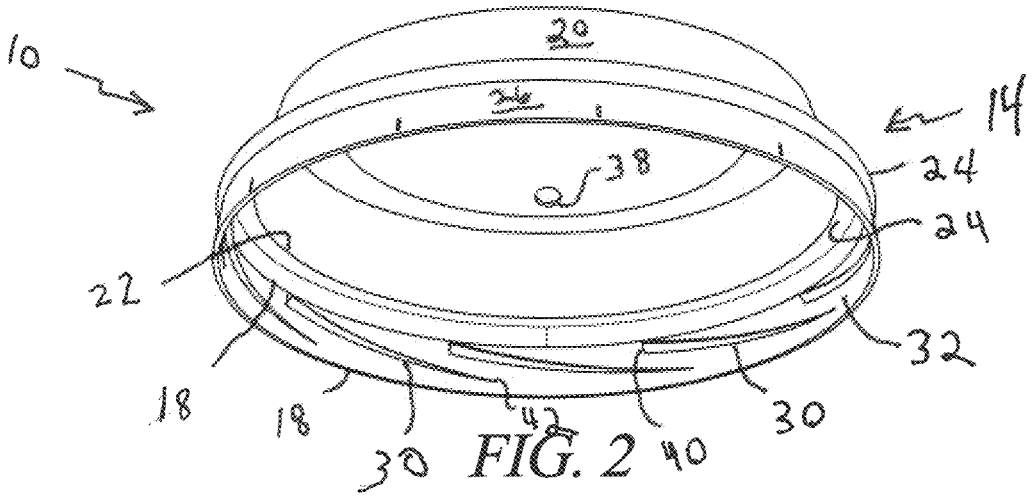
FIG. 2 is a bottom perspective view of the lid of FIG. 1.
Figure 3:
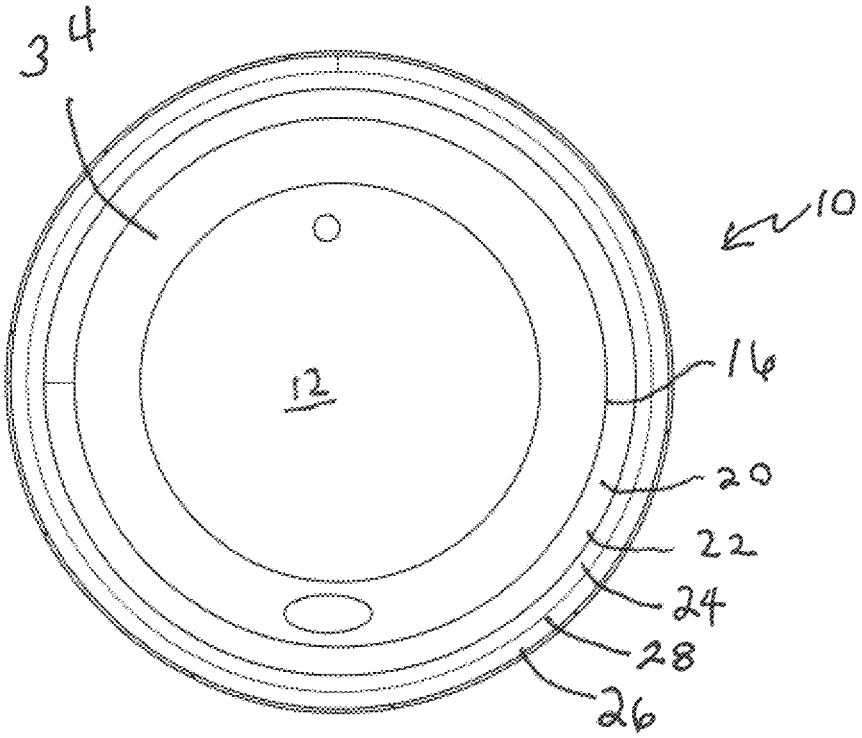
FIG. 3 is a top plan view of the lid of FIG. 1.
Figure 4:
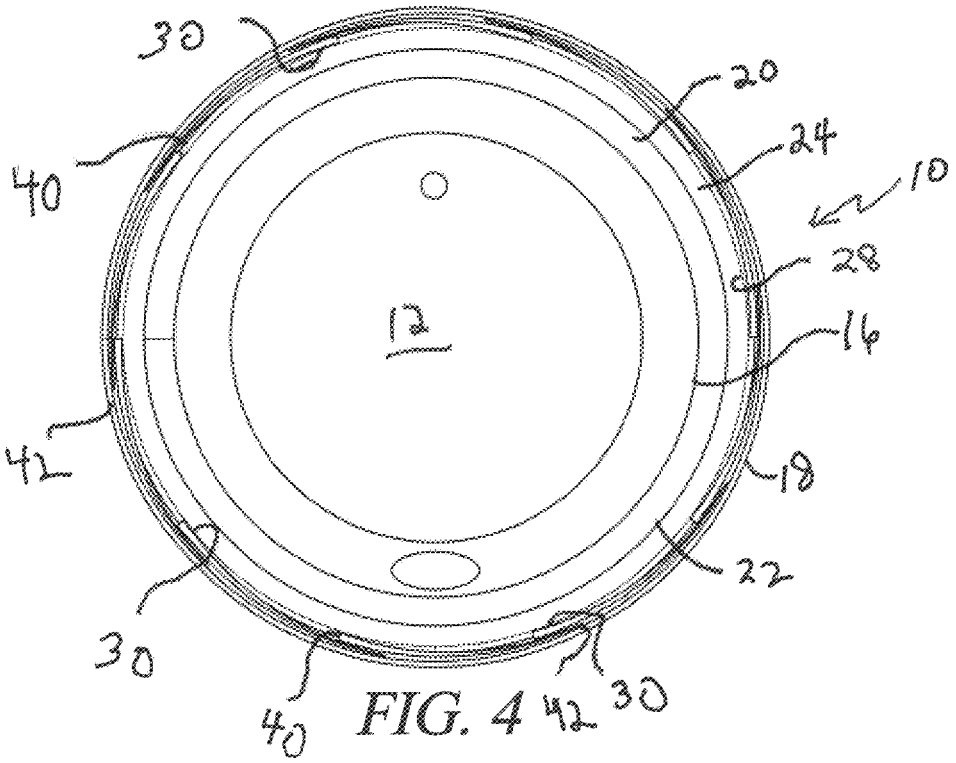
FIG. 4 is a bottom view of the lid of FIG. 1.
Figure 5:
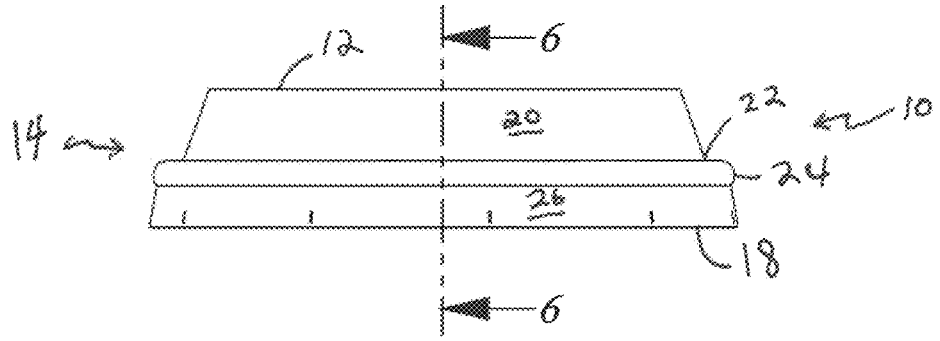
FIG. 5 is a front elevational view of the lid of FIG. 1.
Figure 6:
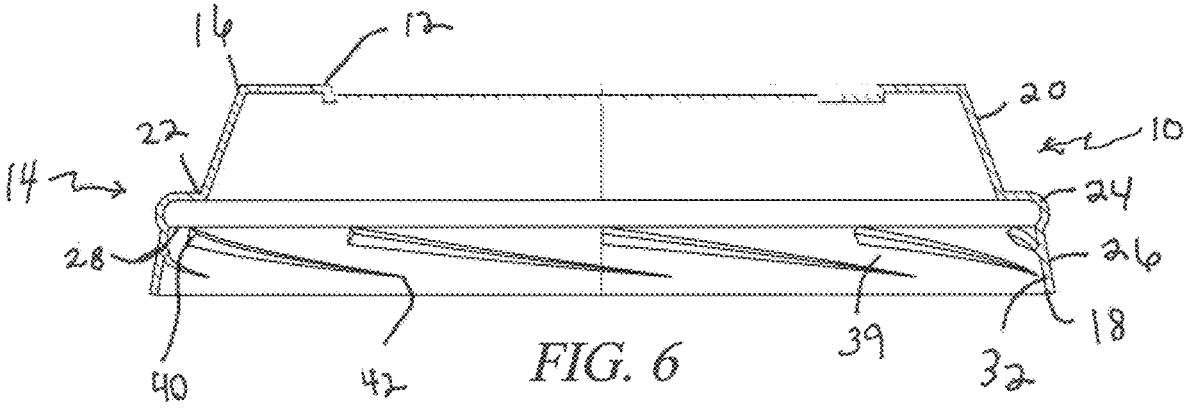
FIG. 6 is a sectional view of the lid of FIG. 5 along line 6-6.
Figure 7:
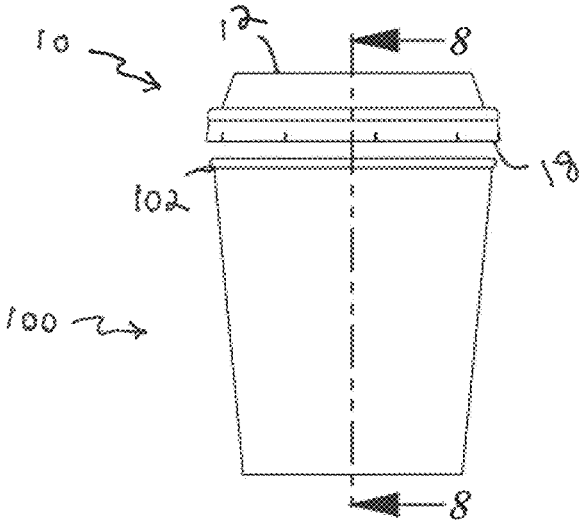
FIG. 7 is an elevational view of the lid of FIG. 1 arranged above a lip of a cup.

FIGS. 1 through 6 depict a lid 10 in accordance with the present invention. FIGS. 7 through 11 illustrate a method for securing lid 10 to a paper cup 100. Lid 10 is configured for deforming a rim of a paper cup and progressively increasing a friction fit tightness between the lid and the rim when the lid is rotated and pressed onto the rim. Generally, lid 10 includes a circular top cover 12 and a continuous sidewall 14 extending downwardly from a periphery 16 of top cover 10 and terminating in an annular rim 18. Continuous sidewall 14 forms three annular wall portions including a substantially flat, outwardly tapering first portion 20, a second portion extending downwardly from an intersection 22 with the first portion and forming an annular groove 24 and an outwardly tapering third portion 26 extending to and between rim 18 and an intersection 28 with annular groove 24. A plurality of spaced-apart ridges 30 extend between intersection 28 and rim 18 and radially inward from an inner surface 32 of third portion 26. Ridges 30 and third portion 26 are configured for causing ridges 30 to securely engage a lip 102 of lid 100 during the process of attaching lid 10 to cup 100 by forming indentations within lip 102 that correspond to ridges 30, while progressively tightening third portion 26 around lip 102 as lid 10 is rotated and pressed against cup 100. In so doing, lid 10 becomes firmly secured to lip 102 prior to lip 102 being received and locked within annular groove 24. Consequently, the likelihood that lid 10 may accidentally dislodge from lip 102 as lid 10 is being secured to cup 100 and thereafter is decreased.

Lid 10 may be constructed of plastic or any other material known in the art of lid fabrication. Suitable plastics include polystyrene, polyethylene terephthalate (PET) and polypropylene. Additionally, lid 10 may be constructed of PLA plastic-coated paper when it's desired to provide a recyclable paper lid. Lid 10 may be manufactured by any means known in the art including thermoforming whereby a heated plastic sheet is placed over a mold and then shaped into the desired lid design using vacuum or pressure, effectively 'drawing' the plastic into the mold's contours to create the final product. The latter method is preferred due to its efficiency and cost-effectiveness in producing large quantities of plastic lids.

Referring to FIGS. 1 through 6, top cover 12 of lid 10 includes a circular center portion 32 bounded by a raised, flat, annular ring 34. Formed through ring 34 is a first hole 36 through which a liquid contained in cup 100, such as coffee, may poured out. A second hole 38 extends through center portion 32 for allowing air to enter cup 100 and replace the liquid thereby preventing a vacuum from forming and ensuring a smooth, even pour without bubbling or splashing.

Extending downwardly and tapering outwardly from annular ring 34 is first sidewall portion 20. First portion 20 is provided for managing pressure and a temperature of a hot liquid contained within cup 100. In particular, first portion 20 creates a space between top cover 12 and lip 102 of cup 100. This space allows steam to form and escape through holes 36 and 38 while equalizing pressure inside cup 100, which helps prevent spills and ensures a smooth flow of liquid through first hole 36. Additionally, the space provides headroom for toppings floating on top of a liquid contained within cup 100. First portion 20 may extend about 13.6 mm downwardly from periphery 16 of top cover 10 and taper outwardly at a 20° angle from a central axis formed through a center of lid.

Extending downwardly from first portion 20 at interstation 22 is annular groove 24. Annular groove 24 has a U or J-shaped cross-section and is configured for receiving lip 102 of cup 100. Annular groove includes a first diameter extending to and between opposing sides thereof at or about intersection 28, a second diameter extending to and between opposing sides thereof at or about intersection 22 and a third diameter extending to and between opposing sides of the vertex of the curve formed by groove 24. So that lip 102 of cup 100 is firmly secured within annular groove 24 when lid 102 is placed on cup 100, the third diameter is slightly less than an outer diameter of lip 102 of cup 100 thereby allowing formation of friction fit between lip 102 and annular grove 24, and the first and second diameters are less than the first diameter thereby forming annular constrictions above and below the lip for maintaining lip 102 there between.

The second continuous sidewall portion forming annular groove 24 may include a substantially flat first segment 37 extending radially outward from intersection 22 with a length of 2.9 mm and a curved second segment 31 extending downwardly from first segment 37 and forming an angle of about 160° thereby providing annular groove 24 with a vertical height of about 3.8 mm defined between intersections 22, 28. It is understood that the degree of curvature and segment lengths for the second sidewall portion may vary to accommodate different lip sizes and diameters.

Extending downwardly from intersection 28 is third continuous wall portion 26. Third portion 26 tapers outwardly as it extends from intersection 28 to annular rim 18. Third portion 26 may have a length of about 7 mm extending to and between rim 18 and intersection 28 and taper outwardly at a 10° angle from the central axis of lid 10. The inner diameter defined between opposing sides of inner surface 32 of third portion 26 progressively decreases from a fourth diameter that is slightly greater than an outer diameter of lip 102 to cup 100 to the first diameter at or about intersection 28, which is less than the outer diameter of lip 102. It is understood that lengths and taper angles of portions 20, 24 and 26 may vary to accommodate different cup sizes.

Arranged circumferentially on and protruding radially inwardly from inner surface 32 of third portion 26 of continuous sidewall 14 are ridges 30. Ridges 30 are evenly spaced apart from one another and define channels 39 there between. Each ridge 30 has a triangular cross-section and includes a first end 40 arranged adjacent to or in contact with intersection 28, an acutely pointed second end 42 arranged adjacent to rim 18, a height defined between a vertex 44 and inner surface 32 of third portion 26 and a width measured between vertices 46, 48, the height and width progressively increasing as the ridge extends from second end 42 to first end 40. Each first end 40 is arranged along a first horizontal plane extending perpendicularly to the central axis of lid 10 and adjacent to or through intersection 28, and each second end 42 is arranged along a second horizontal plane that's parallel to the first horizontal plane and adjacent to rim 18. The number of ridges 30 may vary to accommodate lids with different rim circumferences. In most instances, no more than ten ridges are necessary.

Each first end 40 is placed evenly apart from the other first ends 40 at intervals of 36°. Each ridge 30 tapers downwardly at a 20° angle from intersection 28 and extends horizontally along a 45° arc of the circumference of rim 102. The width of each ridge may be 1.5 mm at first end 40. The width of the ridge narrows at a continuous rate as the ridge extends downwardly such that second end 42 of each ridge 30 is a point. The height of each ridge 30 may steadily decrease from about 1.0 mm to about 0 between each first end 40 and each second end 42. Ridges 30 have a pitch of 35 mm between each ridge, which is about 11° vertically, and each ridge is angled away from the central axis of lid 10 by 20° as the ridge radiates outward. Ridges 30 have a taper of about 0.73 mm per mm. This arrangement of ridges 30 creates a tapered "bite" that allows the ridges to gradually increase the tightness of the friction fit between lid 10 and rim 102. The width, length, shape, and pitch and taper angles of ridges 30 may vary to accommodate different cups and lips.

Figure 8:
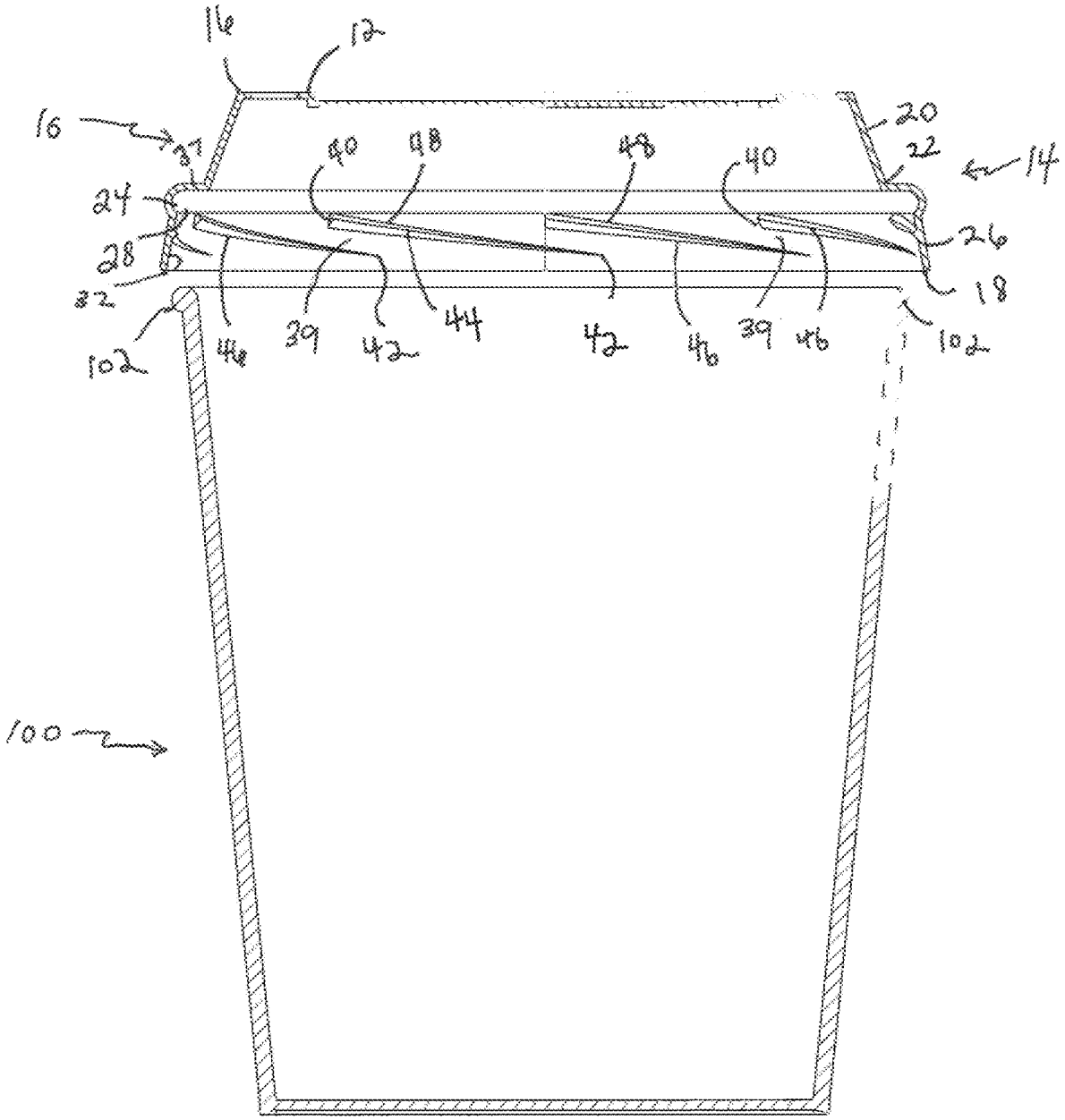
FIG. 8 is a sectional view of the lid and cup of FIG. 7 along line 8-8.
Figure 9:
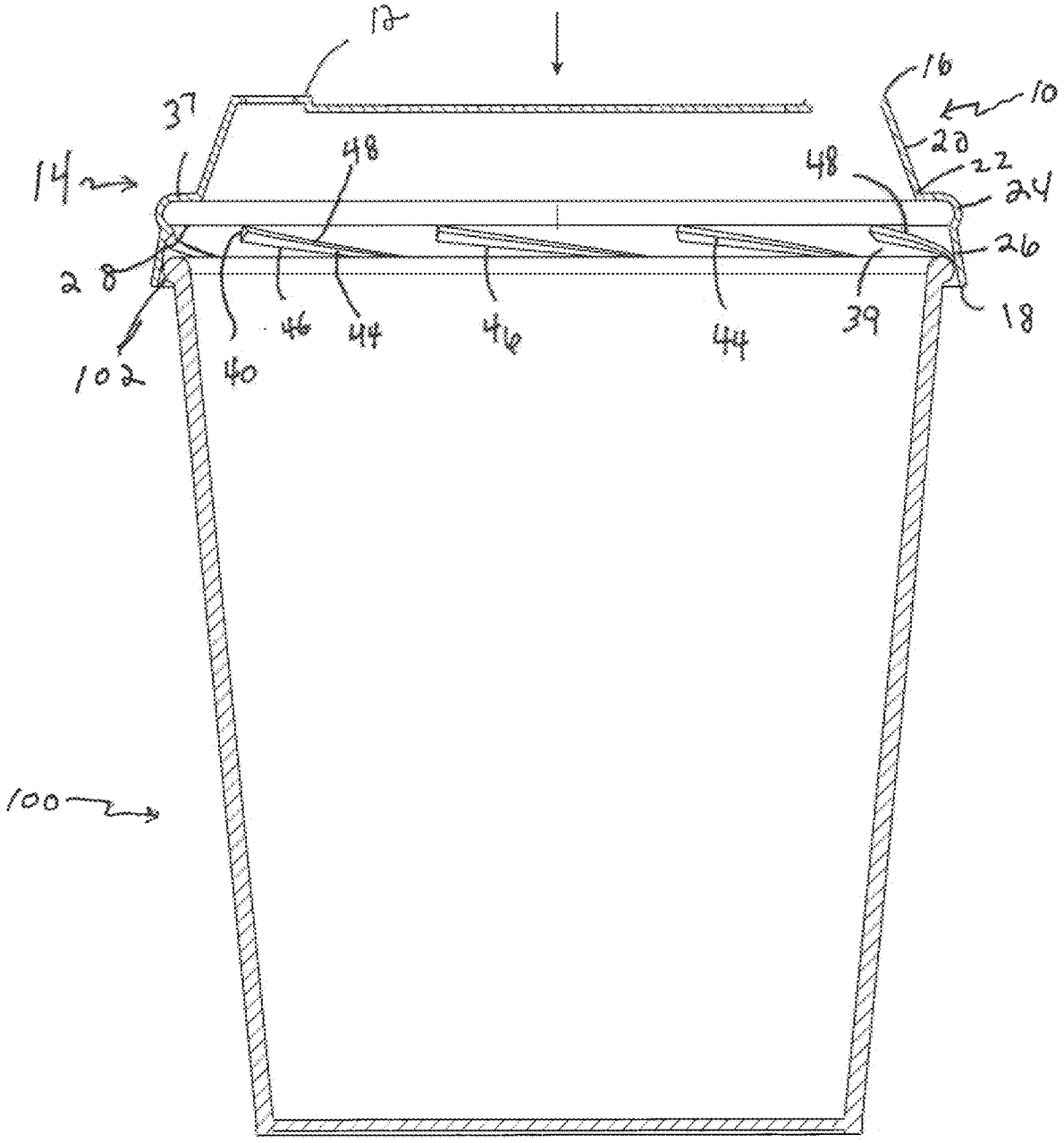
FIG. 9 is a sectional view of the cup and lid of FIG. 8 depicting the lip of the cup initially engaged with the lid.
Figure 10:
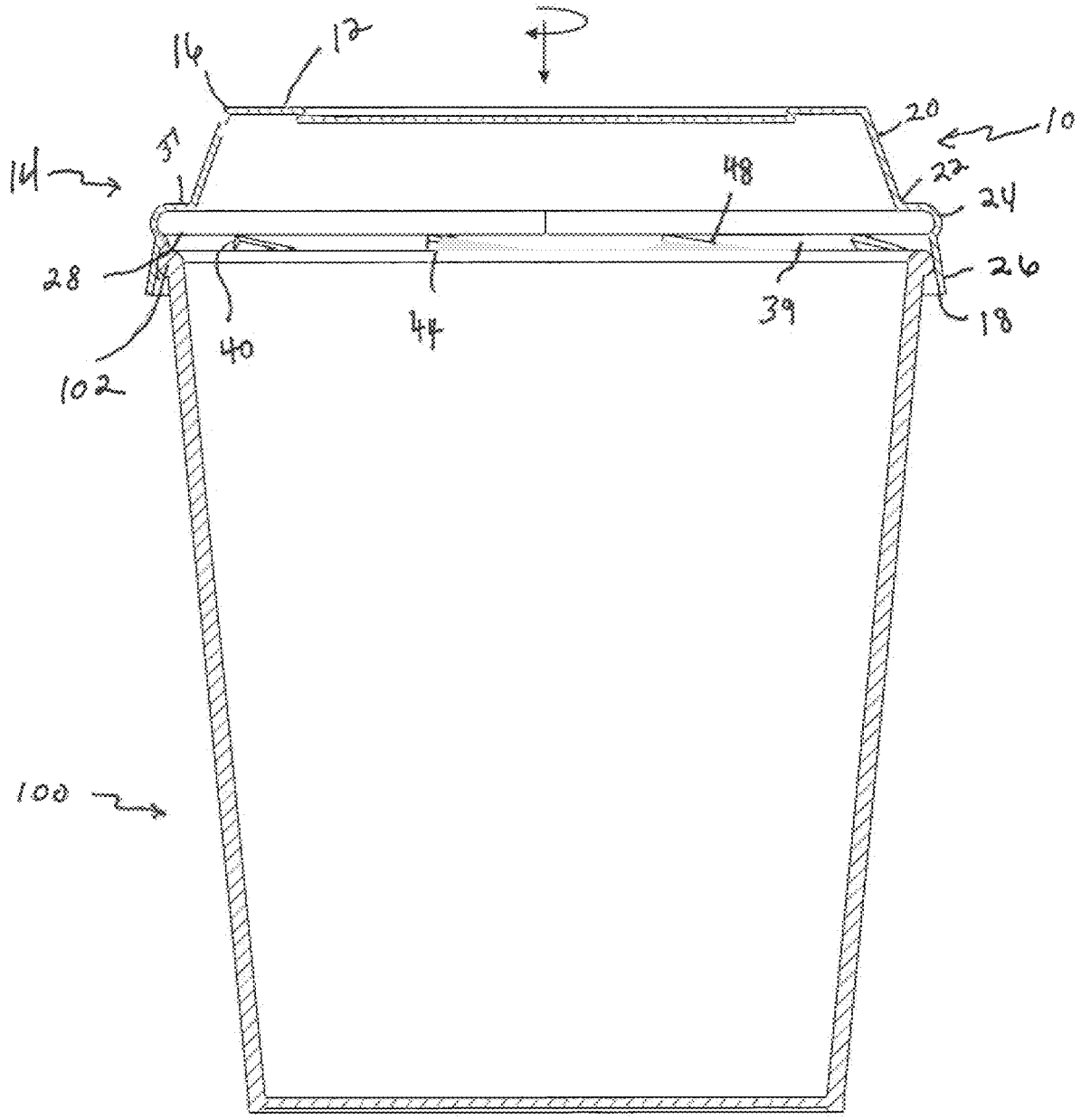
FIG. 10 is a sectional view of the cup and lid of FIG. 8 depicting the lip engaged with ridges formed on an inner surface of the lid.
Figure 11:
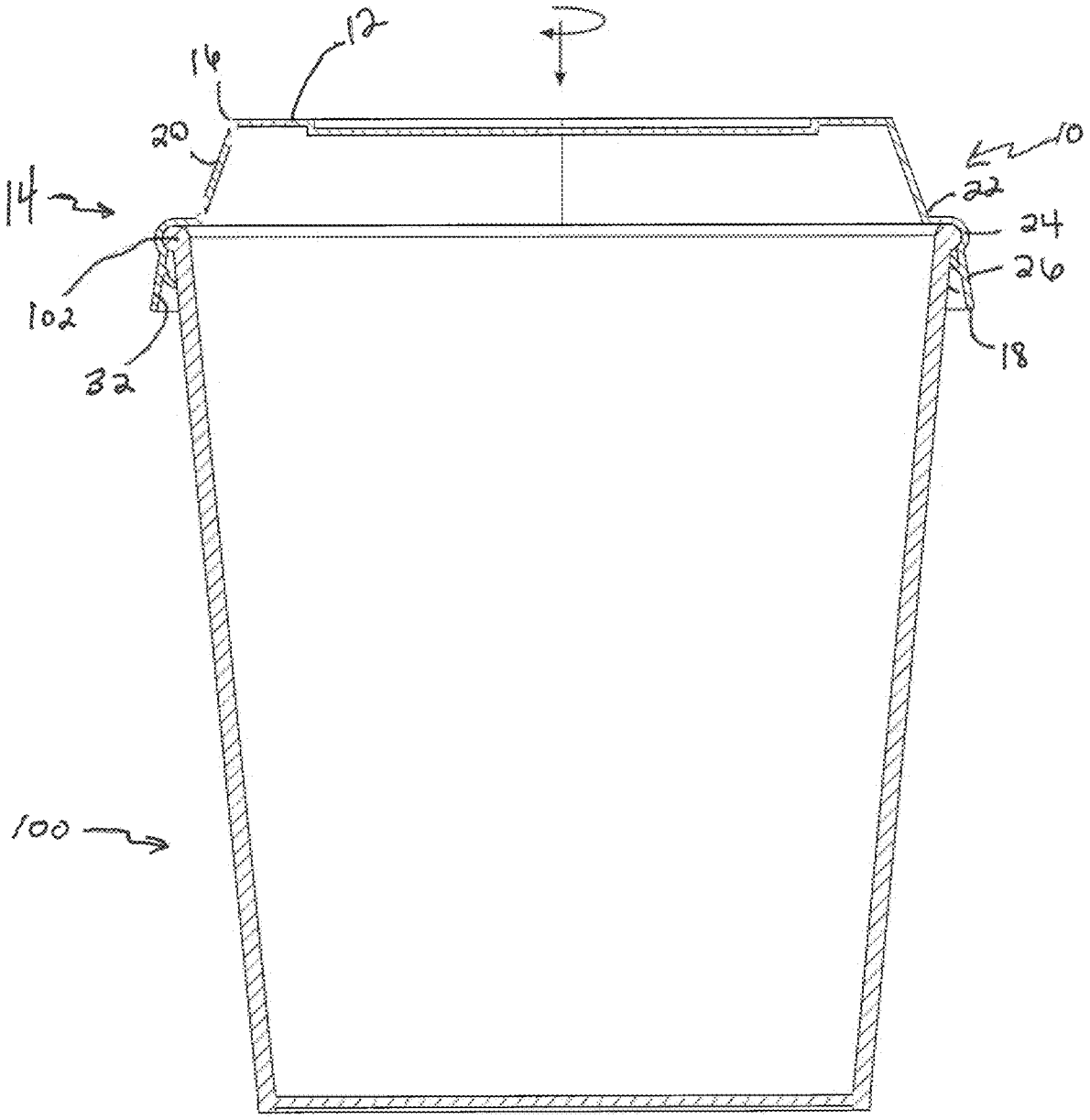
FIG. 11 is a sectional view of the cup and lid of FIG. 8 depicting the lid secured to the cup.

FIGS. 7 through 11 depict a method for securing lid 10 to cup 100. To begin, lid 10 is placed over cup 100 as illustrated in FIG. 8. Lid 10 is then lowered onto cup 100 such that second ends 42 of ridges 30 contact lip 102 and support the lid on top of cup 100. Lid 10 is simultaneously pressed downwardly onto cup 100 and rotated clockwise so that acutely pointed second ends 42 of ridges are allowed to engage lip 102. As second ends 42 engage lip 102, ridges 30 bite into and form indentations within lip 102 which guide ridges 30 along lip 102 as lip 102 advances toward annular groove 24. These actions in concert with the arrangement of ridges 30 and channels 39 and the progressive decrease in inner diameter of third portion 26 cause lid 10 to twist about lip 102 in a manner that corresponds with the twist defined by ridges 30 and channels 39, while progressively increasing the tightness of the friction fit formed between ridges 30 and channels 39, on the one hand, and lip 102, on the other hand. Rotation and pressing of lid 10 onto cup 100 ends when lip 102 is received and locked within annular groove 24. At this point, cup 100 cannot be moved any further into lid 10.

Although a specific order of method steps has been described herein, the order of the steps may differ from what is described. Also, two or more steps may be performed concurrently or with partial concurrence. Variations in step performance can depend on the version of the lid chosen and on designer choice. All such variations are within the scope of the application. It should be understood that the identified lid is offered by way of example only. Other substitutions, modifications, changes and omissions may be made in the design, operating conditions and arrangement without departing from the scope of the present application. Accordingly, the present application is not limited to a particular lid, but extends to various modifications that nevertheless fall within the scope of the application. It should also be understood that the phraseology and terminology employed herein is for the purpose of description only and should not be regarded as limiting.

What is claimed is:

1. A lid for a cup comprising:

a top cover, a first continuous sidewall extending downwardly from an outer edge of the top cover, a curved, second continuous sidewall extending downwardly from the first continuous sidewall, wherein the second continuous sidewall forms an annular groove, a third continuous sidewall extending downwardly from a lower edge of the second continuous sidewall, wherein the third continuous sidewall tapers outwardly from the lower edge of the second continuous wall and terminates to form a rim, a plurality of ridges arranged circumferentially on and protruding radially inwardly from an inner surface of the third continuous sidewall, wherein each ridge of the plurality of ridges includes a first end arranged adjacent to the annular groove, a second end arranged adjacent to the rim, and a height that progressively increases as the ridge extends from the second end to the first end, and a plurality of channels, each channel being defined between adjacent ridges of the plurality of ridges and having a pitch in the range of about 25 mm to about 45 mm.

2. The lid of claim 1, wherein each channel has a pitch of about 35 mm.

3. The lid of claim 1, wherein each ridge has a triangular cross-section.

4. The lid of claim 1, wherein each ridge has a width that progressively decreases as the ridge extends from the first end to the second end.

5. The lid of claim 1, wherein the first end of each ridge of the plurality of ridges contacts the lower edge of the second continuous sidewall.

6. The lid of claim 1, wherein the plurality of ridges are configured for engaging a lip of a paper cup during the process of securing the lid to the paper cup and forming indentations circumferentially around the lip.

7. The lid of claim 1, wherein an annular groove is configured for receiving a cup lip.

8. A method of securing the lid of claim 1 to a cup including arranging the rim around a lip of the cup and pressing the lid downward onto the lip while rotating the lid, whereby the plurality of ridges impinge upon and deform the lip, and depositing the lip within the annular groove.

9. A method of securing a lid to a cup comprising:

providing a lid having, a top, a continuous sidewall extending downwardly from the top and terminating to form a rim, an annular groove formed in the continuous sidewall, a plurality of ridges arranged circumferentially on and protruding radially inwardly from an inner surface of the continuous sidewall, wherein each ridge of the plurality of ridges includes a first end arranged adjacent to the annular groove, a second end arranged adjacent to the rim, and a height that progressively increases as the ridge extends from the second end to the first end, arranging the rim around a lip of the cup, contacting the second end of each ridge of the plurality of ridges with the lip, pressing the lid against the plurality of ridges while rotating the lid, whereby each ridge of the plurality of ridges deforms the lip, and sliding the lip along from the second end to the first end of each ridge of the plurality of ridges and thereafter depositing the lip within the annular groove.

10. The method of claim 9, wherein pressing the lid against the plurality of ridges while rotating the lid forms a plurality of indentations within the lip, the plurality of indentations being circumferentially arranged about the lip.

11. The method of claim 9, wherein the plurality of ridges includes at least ten ridges.

12. The method of claim 9, wherein the continuous sidewall includes a plurality of channels, each channel being defined between adjacent ridges of the plurality of ridges and having a pitch in the range of about 25 mm to about 45 mm.

13. The method of claim 9, wherein no ridge of the plurality of ridges is in contact with another ridge of the plurality of ridges.

14. The method of claim 9, wherein each ridge of the plurality of ridges has an arc measure of about 45 degrees along a circumference of the rim.

15. A cup lid comprising:

a top cover, a continuous sidewall extending downwardly from the top cover and terminating to form a continuous rim, an annular groove formed in the continuous sidewall, a continuous sidewall portion extending to and between an edge of the annular groove and the continuous rim, wherein the continuous sidewall portion tapers outwardly from the edge of the annular groove as it extends to the continuous rim, and a plurality of ridges arranged circumferentially on and protruding radially inwardly from an inner surface of the continuous sidewall portion, wherein each ridge of the plurality of ridges includes a first end arranged adjacent to the annular groove, a second end arranged adjacent to the continuous rim, and a height that progressively increases as the ridge extends from the second end to the first end, wherein no ridge of the plurality of ridges contacts another ridge of the plurality of ridges.

16. The cup lid of claim 15, wherein each ridge of the plurality of ridges has an arc measure in the range of about 30 degrees to about 55 degrees along a circumference of the continuous rim.

17. The cup lid of claim 15, wherein the continuous sidewall portion includes a plurality of channels, each channel being defined between adjacent ridges of the plurality of ridges and having a pitch in the range of about 25 mm to about 45 mm.

18. The cup lid of claim 15, wherein each ridge of the plurality of ridges is formed by two walls extending from the sidewall portion and intersecting an angle of about 90 degrees or less.

19. The cup lid of claim 15, wherein each ridge has a width that progressively decreases as the ridge extends from the first end to the second end.

20. A method of securing the cup lid of claim 15 to a cup including arranging the rim around a lip of the cup and pressing the cup lid downward onto the lip while rotating the lid, whereby the plurality of ridges impinge upon and deform the lip, and thereafter depositing the lip within the annular groove.

* * * * *